US008834281B1

(12) United States Patent
Hilsen et al.

(10) Patent No.: US 8,834,281 B1
(45) Date of Patent: Sep. 16, 2014

(54) DEPLOYABLE ELEVATED MAINTENANCE PLATFORM FOR ROUND RIDE

(71) Applicant: Disney Enterprises, Inc., Burbank, CA (US)

(72) Inventors: Donald Robert Hilsen, La Canada, CA (US); Guillermo L. Herrejon, Burbank, CA (US); Anthony Steven Castillo, Shanghai (CN)

(73) Assignee: Disney Enterprises, Inc., Burbank, CA (US)

( * ) Notice: Subject to any disclaimer, the term of this patent is extended or adjusted under 35 U.S.C. 154(b) by 79 days.

(21) Appl. No.: 13/779,130

(22) Filed: Feb. 27, 2013

(51) Int. Cl.
*A63G 1/24* (2006.01)
*A63G 1/08* (2006.01)
*A63G 31/16* (2006.01)

(52) U.S. Cl.
CPC ..... *A63G 1/08* (2013.01)
USPC ..... 472/39; 472/130

(58) Field of Classification Search
USPC ..... 472/27, 28, 29, 32, 33, 39, 130
See application file for complete search history.

(56) References Cited

U.S. PATENT DOCUMENTS

| | | | | |
|---|---|---|---|---|
| 2,113,131 | A * | 4/1938 | Eyerly | 472/39 |
| 2,312,533 | A * | 3/1943 | Eyerly | 472/30 |
| 2,468,893 | A * | 5/1949 | Orance | 472/39 |
| 2,570,981 | A * | 10/1951 | Psaila | 472/33 |
| 7,854,660 | B2 * | 12/2010 | Crawford et al. | 472/39 |

* cited by examiner

*Primary Examiner* — Kien Nguyen
(74) *Attorney, Agent, or Firm* — Marsh Fischmann & Breyfogle LLP; Kent A. Lembke

(57) ABSTRACT

A round ride adapted for efficient and safe maintenance of elevated components. The ride includes a central hub assembly with a hub and a hub drive adapted for selectively rotating the hub about a central axis. The hub assembly includes a plurality of vehicle support arms pivotally mounted at a first end to the hub and extending outward to a second end. The round ride includes a maintenance platform assembly with, for each of the vehicle support arms, extension plates proximate to the first end and extending outward from sides of the vehicle support arm. The extension plates each include a planar upper surface, and the planar upper surfaces are coplanar with an upper surface of the vehicle support arm. When the support arms are pivoted into a horizontal position, the upper surfaces of the plates combined with the upper surfaces of the arms creates a platform near the hub.

26 Claims, 4 Drawing Sheets

DEPLOYABLE ELEVATED MAINTENANCE PLATFORM FOR ROUND RIDE

BACKGROUND

1. Field of the Description

The present description relates, in general, to maintenance of amusement park rides and other entertainment rides such as round rides, and, more particularly, to maintenance platforms for use with round rides, e.g., rides with pivotal arms supporting ride vehicles, that extend out from a central hub rotated to move vehicles about a central axis, or to round rides adapted with a deployable, elevated maintenance platform.

2. Relevant Background

Amusement and theme parks are popular worldwide with hundreds of millions of people visiting the parks each year. Many parks include numerous round rides that include vehicles or gondolas mounted on support arms extending outward from a centrally located drive or rotation assembly (rotating central hub structure). The passengers or riders sit in the vehicles and are rotated in a circle about the drive assembly, which spins about its central axis. These rides are very popular with younger children and families.

A round ride includes a central structure or central hub that is rotated at relatively low rates such as 4 to 10 revolutions per minute. The hub structure in many round rides may take the form of one of the drive and support assemblies designed and distributed by Zamperla, Inc., 49 Fanny Road, Parsippany, N.J., USA or assemblies provided by other similar ride design and production companies. These conventional round rides are popular with park operators in part because they require only a small footprint of precious park space (such as when compared with a roller coaster or water ride) and are relatively easy to operate including loading and unloading of passengers. While existing round rides provide an enjoyable experience and likely will continue to be a mainstay for amusement and theme parks, there is a demand among park operators to reduce the cost and time required to maintain round rides and to maintain or even improve the safety of the maintenance workers repairing the rides.

Presently, maintenance of round rides involves maintenance personnel bringing additional equipment to the site of the ride so that they can safely access portions of the central drive assembly or hub structure. For example, ladders and/or manlifts are used to allow the workers to reach mid-to-upper portions of the central drive assembly, e.g., the workers would place ladders between the raised vehicle-support arms and climb up onto the hub structure. Because of the fall potential at the elevated heights, the maintenance personnel also needs to wear safety harnesses, which sometimes restrict their movement and ability to perform certain maintenance tasks. As a result, maintenance of a round ride requires extensive planning to select and provide all the extra equipment, and the cost of maintenance is relatively high because complying with safety requirements such as safety harnesses and extra personnel for safety support or spotters increases the man hours required to perform even simple maintenance at elevated heights associated with the round rides.

Hence, there remains a need for ride and/or maintenance tool designs that make maintenance activities on the round rides easier for personnel and that reduce the cost of maintaining such round rides. Such ride and maintenance tool designs preferably would be configured with a focus on safety and efficient performance of maintenance tasks. Preferably, such a ride design or maintenance tool assembly would allow maintenance personnel to safely access at mid-to-upper portions of the hub structure without the need for additional equipment such as safety harnesses and ladders.

SUMMARY

The present invention addresses the above problems by providing a round ride with a deployable, elevated maintenance platform (or by providing a maintenance platform for use with a round ride having vehicle support arms extending outward from a rotatable hub structure). The round rides described herein generally include a rotating hub to which a number of arms are pivotally attached, and a passenger vehicle is provided on the end of each arm so as to rotate with the hub about a vertical center axis.

In brief, the deployable maintenance platform assembly of the present description utilizes the vehicle support arms to provide a walking surface, which is made up of a plurality of extension plates (or planar platform elements or members). The walking surface is adapted to allow maintenance personnel to stand and walk upon the walking surface provided by the upper planar surfaces of the extension plates so as to circumnavigate the central rotatable hub (which includes pivoting components that may require maintenance).

The maintenance platform assembly is adapted such that, in use, the support arms are raised from a lower position (e.g., the ride load/unload position) via a manual pneumatic valve until the support arms reach a substantially horizontal position (e.g., longitudinal axes of the support arms are in a horizontal plane or an upper surface of each support arm is coplanar). The support arms are held in place, i.e., in the horizontal position, such as with a pneumatic circuit that may include a set of blocking valves and with a mechanical piston locking device (e.g., a redundant measure such as rod locking collars or the like) to prevent the support arms from lowering in the event of loss of pressure in the pneumatic system.

Significantly, the vehicle support or lift arms are equipped with extension plates that extend outward in a lateral direction from each side of each support arm to provide the walking or maintenance surface with the arms in the horizontal position. The plates may be attached to the sides (or tops or bottoms) of the arms and configured/arranged such that the plates (or their upper surfaces) are flush with the top surfaces of the support arms. In practice, when the support arms are placed and held in the horizontal position, the extension plates (when considered as a set or assembly) create a hexadecagon platform.

The platform assembly's plates are attached to the ride structure (vehicle support arms) almost around the entire circumference of the hub (but, typically, within a hub shell or exterior wall that hides or disguises the presence of the arm pivoting mechanism assembly and the maintenance platform), and, as a result, the plates act together to provide a walking surface near the inner walls or surfaces of the hub structure. Openings in the created walking surface are provided so as to retain access points for the maintenance personnel, e.g., a ladder may be built into the lower portions of the hub structure below the horizontally arranged maintenance platform.

Without the plates, there would be a gap or space between adjacent pairs of the support arms, and the plates are shaped and sized so as to nearly completely fill this generally triangular-shaped gap (but with a clearance so they do not bind or contact edges of neighboring or adjacent extension plates in the horizontal position of the arms or as the arms are raised even further during ride operations). The gap typically has a width as measured between adjacent support arms that increases with distance from the rotation or central axis of the hub, and the plates may be designed also to have a width that increases along the length of the support arm to which they are attached (e.g., a first width proximate to the hub axis (or at the inner edge of the plate) that is smaller than a second width distal to the hub axis (or at the outer edge of the plate). The magnitude of the plate width typically is less than about 50 percent of the width of the gap or spacing between adjacent support arms (such as to leave a clearance of 2 to 6 inches or the like between adjacent edges of two "adjoining" extension plates with the two support arms upon which the plates are mounted in the horizontal position).

More particularly, a ride apparatus or round ride is provided that is adapted for more efficient and safe maintenance of elevated surfaces or components. The round ride includes a central hub assembly with a hub and a hub drive adapted for selectively rotating the hub about a central axis. The hub assembly further includes a plurality of vehicle support arms pivotally mounted at a first end to the hub and extending outward to a second end. Further, the round ride includes a maintenance platform assembly that includes, for each of the vehicle support arms, at least one extension plate proximate to the first end and extending outward from a side of the vehicle support arm.

In some embodiments, the at least one extension plate includes a planar upper surface, and the planar upper surface is coplanar with an upper surface of the vehicle support arm. In other cases, the maintenance platform assembly includes a pair of the extension plates extending outward from opposite sides of the first end of the vehicle support arm. In these cases, each of the extension plates includes a planar upper surface, and the upper surfaces may be substantially coplanar with the horizontal plane when the vehicle support arm is positioned in a substantially horizontal position.

Further, each of the extension plates may have a first edge proximate to the hub with a first width and a second edge distal to the hub with a second width greater than the first width. Then, it may be useful if the extension plates are configured to be spaced apart from ones of the extension plates on adjacent ones of the vehicle support arms throughout a full range of motion of the vehicle support arms (e.g., the widths of the plates may be less than about half the separation distance between the arms in the horizontal position so as to define a gap of less than about 6 inches between the edges of adjacent plates of the platform when the arms are in the horizontal position).

In some implementations, the central hub assembly further includes an actuator for each of the vehicle support arms. Then, it may be useful that the actuators be operable to pivot the vehicle support arms into horizontal positions for maintenance. The maintenance platform assembly may further include mechanical locking devices applied to the actuators to retain the vehicle support arms in the horizontal positions (e.g., in addition to a blocking valve in the pneumatic circuit/system locking the actuator rod in an extended position).

DETAILED DESCRIPTION

Briefly, the description is directed to a round ride with vehicle support arms extending outward from a central hub structure, and the central hub structure includes a drive assembly for rotating the hub structure along with the support arms and passenger vehicles attached to the arms about a central or vertical rotation axis. The round ride includes a maintenance platform assembly that is deployed by positioning each of the vehicle support arms in a horizontal position and then locking the arms in this maintenance position.

To allow such deployment, the maintenance platform assembly comprises a plurality of extension plates or planar support members/elements that are mounted onto the support arms at a location adjacent to the inner surfaces or walls of the central hub and arranged to extend outward from the arms transverse to the longitudinal axis of the arms. Particularly, the extension plates extend outward with the arms in the horizontal position to create a planar and, typically, horizontal walking surface that may be flush or continuous with the top surfaces of the support arms. The extension plates are sized and shaped to substantially fill the gap or space between the support arms (or a large enough portion of this gap to make maintenance work safe), when the arms are in the horizontal position but without binding or contacting each other.

The deployable maintenance platform assembly taught herein provides a number of advantages over prior maintenance practices. First, it creates a safer working environment for the maintenance personnel working on an armed round ride. Second, the solution proposed by the inventors also reduces the amount of time required to perform the maintenance as well as the amount of additional equipment. With personnel spending less time with extra equipment setup, the maintenance cost for round ride attractions can be significantly reduced for park operators.

The solution is a safer approach to maintaining round rides, and the workers do not need to wear safety harnesses to work on elevated surfaces as the fall potential has been eliminated by the deployable maintenance platform assembly. One large advantage associated with use of the platform assembly is that it utilizes the ride system's features as a part of the equipment that would otherwise have to be brought to the site (e.g., the support arms and associated pneumatic systems act as lifts for the platform's extension plates). The top surfaces of the elevated arms typically create a flat working surface when combined with the upper surfaces of the extension plates. With the proposed maintenance platform assemblies there is no need to maintain equipment from ladders using fall protection harnesses, which can impede movement or even prevent full range of motion.

Figure 1:
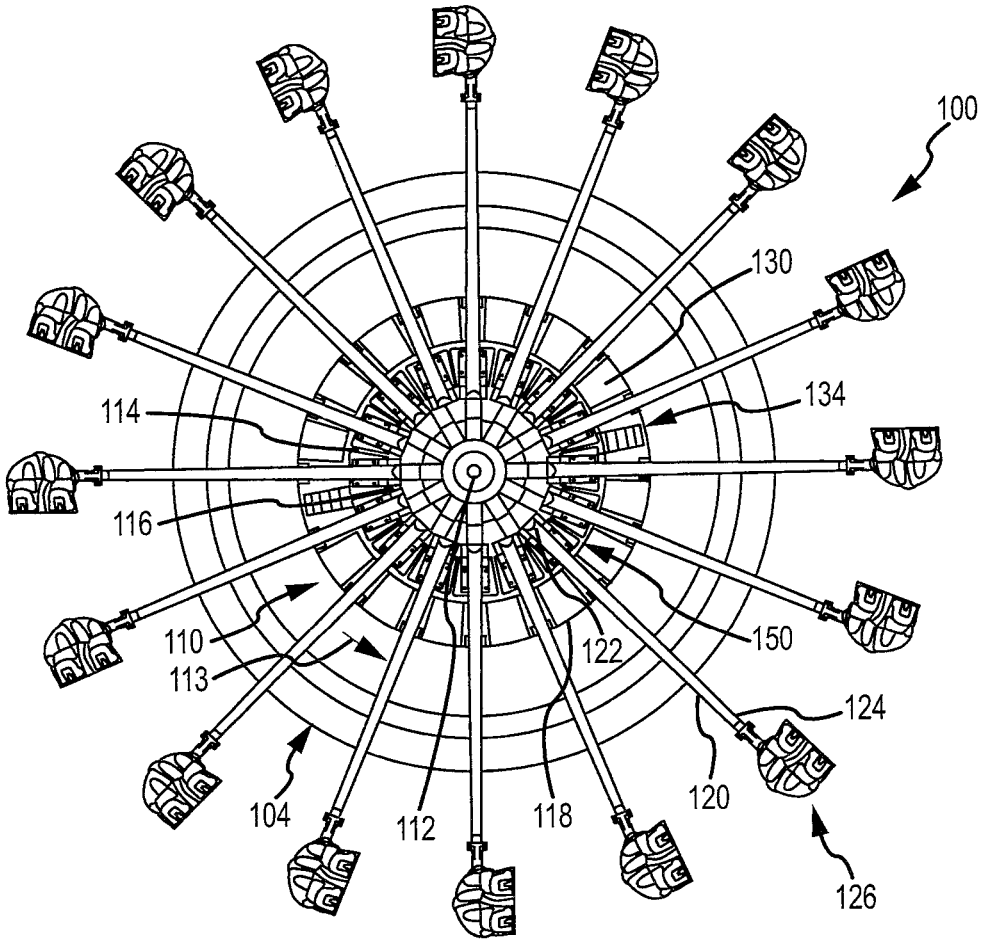
FIG. 1 is a top view of a round ride with a deployable maintenance platform according to an embodiment of the present description.

FIG. 1 illustrates a round ride 100 according to one embodiment of this description that is adapted for more efficient and safe maintenance. To this end, the round ride 100 includes a deployable maintenance platform assembly 150, which is discussed in detail below. Briefly, though, the assembly 150 is made up of a plurality of extension plates that are rigidly mounted to or affixed to inner ends of each vehicle support arm of the ride to create a maintenance walking surface for workers that may access the platform surface of assembly 150 via access ladder 134.

The round ride 100 includes a platform or base upon which a central hub structure 110 (as may be common for round rides) is mounted. The central hub structure 110 includes a hub Or drive assembly) 114 that operates to rotate 113 the hub structure 110 about a center or central (or rotation) axis 112 of the hub structure 110 and ride 100. Generally, as shown from the top view in FIG. 1, the ride 100 is a built upon or provided through use of a multi-arm round ride platform. With this in mind as one useful, but not limiting example, the ride 100 may include the central hub structure 110 with the hub (or drive assembly) 114, which may be configured as for a typical round iron ride, e.g., may take the form of one of the drive and support assemblies designed and distributed by Zamperla Inc., 49 Fanny Road, Parsippany, N.J., USA or assemblies provided by other similar ride design and production companies.

The ride 100 includes the hub (or drive assembly) 114 within a center support structure 110 that is positioned upon a base 104. In contrast to most common round rides, the support structure or hub 110 houses a plurality of arm actuators for pivoting booms or support arms 120. The arms 120 are each coupled in a pivotal manner at proximal/inner ends 122 to support structure or hub 114 via a pivotal coupling that allows the arm 120 to freely pivot as the vehicle 126, which is attached at a distal/outer end 124 of the arm 120, is rotated 113 with hub structure 110.

The central hub structure 110 includes an inner wall or surface(s) 116 that enclose or define the hub 114, and the end 122 of each arm 120 is pivotally mounted to the hub 114 at or near this inner wall/surface(s) 116. In some embodiments of the ride 100, the inner wall/surface(s) 116 may define a cylindrical volume with its longitudinal axis coinciding with the rotation axis 112 of the ride 100, and the drive assembly or portions of such an assembly may be housed within the wall 116.

The central hub structure 110 further is defined by or includes an outer wall or surface(s) 118, which may be configured to be spherical in shape. The outer wall 118 encloses or hides some of the working components of the ride 100 such as the hub 114 and the pivotal mounting points and components for the ends 122 of arms 120. As with the inner wall 116, the outer wall 118 rotates with the hub 114, and the arms 120 extend outward through a window or slot in the wall 116.

In some embodiments, the central hub structure 110 further includes a platform 130 made up of a number of planar members or sheets (e.g., metal plates) that are rigidly attached to the inner surfaces of the outer wall 130 and extend toward the central axis 112. The plates of platform 130 are spaced apart from each other to allow the arms 120 to be raised and lowered or passed through the platform 130 during operation of the ride 100. Further, the hub structure 110 may include one or more openings in the platform 130 that may be allow personnel to access the interior spaces of the hub structure 110 via an access ladder 134.

Prior to the present invention, additional equipment would have to be used to work on or maintain portions of the hub structure 110 near the hub 114 and inner wall/surfaces 116. This was because there was a gap or hole between the arms 120, the sphere platform 130, and the inner surface/wall 116. For example, a triangular hole would have present between adjacent pairs of the arms 120 that may have a height 2 to 4 feet and a width of 1 to 3 feet, and this created a fall hazard as workers could step into or fall into this hole and be injured. The fall hazard was previously addressed using ladders to access elevated surfaces and use of safety harnesses.

In contrast, though, the ride 100 includes the deployable platform assembly 150. The assembly 150 acts to fill this dangerous hole or gap and provide a platform or surface upon which the workers may stand or walk while they perform maintenance on components at or near the inner wall 116 or in the hub 114. To this end, the assembly 150 includes a pair of extension plates or planar support members/elements affixed to each of the arms 120. Typically, as explained further below, the extension plates may be affixed to the sides of the arm 120 at or near the inner end 122.

The extension plates may be planar members, e.g., may be formed with a body formed from a metal sheet or the like selected to be strong enough to support workers during maintenance, and the upper surfaces of the planar members or bodies may be arranged to be flush with (or coplanar with) the upper surfaces of the arms 120 (when the arms have rectangular cross sections). In this manner, the platform assembly 150 provides a walking surface or platform that extends about the circumference of the hub 114 proximate to the inner wall or surface 116 (e.g., there may be a space of up to several inches to avoid binding with the inner edge of the extension plate and the outer surfaces of the inner wall 116).

Figure 2:
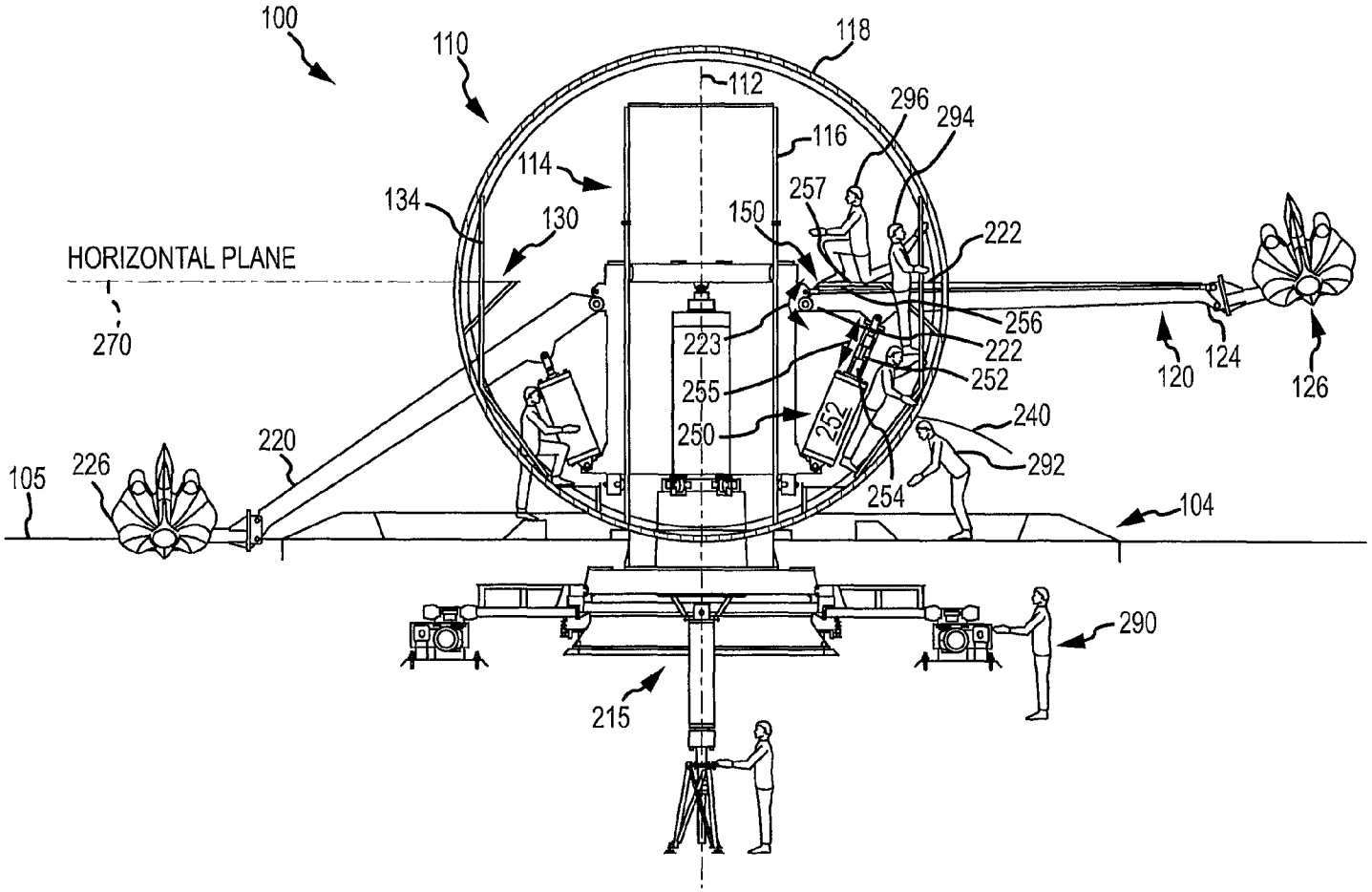
FIG. 2 is a cutaway partial side view (e.g., showing only two vehicle support arms and showing the inner volume or space of the central hub structure by removing a portion of the spherical outer wall of the central hub structure) of the round ride of FIG. 1 further illustrating the deployable maintenance platform.

FIG. 2 is a cutaway side view of the round ride 100 of FIG. 1 further illustrating the deployable maintenance platform 150. The view in FIG. 2 is a partial view in that it only shows two vehicle support arms 120 and 220. Arm 220 is shown in a lowest or unload position with the passenger vehicle 226 placed on or adjacent to the ground or an unloading platform 105. Two arms 120, 220 are shown to show the arms may be moved or pivoted into differing positions during ride operations to support maintenance, for example, as shown with arm 120. The arms 120, 220 are shown to extend outward from hub structure 110 through the outer wall or shell surfaces 118.

In this embodiment, the round ride 100 includes a drive assembly 215 for rotating the central hub 114 (and interconnected arms 120, 220 and outer wall 118) about the rotation axis 112. Portions of the drive assembly 215 may be located under the base 104, and FIG. 2 illustrates that access may be provided to the drive assembly 215 to allow personnel/workers 290 to perform maintenance activities.

FIG. 2 provides a cutaway of the outer shell or spherical-shaped wall 118 to expose or show the inner volume or space of the central hub structure 110. To perform maintenance on the upper or elevated surfaces within the hub structure 110, the vehicle support arms of the round ride 100 are positioned in a horizontal position. This is shown with support arm 120, which is pivotally connected at an inner or first end 122 to the hub 114 near or at inner wall 116. Prior to maintenance, the arm 120 is pivoted 223 up into the horizontal position (the arm 120 is substantially horizontal) shown in FIG. 2 with an upper surface 222 of the body of the arm 120 in or parallel to a horizontal plane 270 (with "substantially horizontal" being parallel to horizontal as measured with surface 222 or a longitudinal axis of the arm 120 or within plus or minus 10 degrees from the horizontal plane 270).

The round ride 100 includes an actuator 250 operable to selectively pivot or position 223 the arm 120. To this end, the actuator 250 includes a piston 252 driven by a pneumatic circuit to move or linearly articulate 255 piston rod 254, which is attached at an end to the bottom of the body of arm 120. The deployable maintenance platform assembly 150 includes one or more devices that are operable or adapted to lock the actuator 250 in position with the arm 120 in the horizontal position. For example, the assembly 150 may include (or utilize an existing) a blocking valve in the pneumatic circuit used to drive the piston 252 to lock the rod 254 in the extended position shown in FIG. 2. Further, to prevent movement 255 upon loss of pneumatic pressure, the assembly 150 may include actuator rod collars 256 that can be placed about the rod 254 and mechanically prevent the rod 254 from being withdrawn into piston 252 and arm 120 from moving out of the horizontal position shown in FIG. 2. The collar 256 may take the form of a metal tube that goes around the piston rod 254 and functions as a piston locking device (e.g., a mechanical backup for the pneumatic locking provided by the blocking valve (not shown in FIG. 2), which may fail upon loss or changes in circuit or pneumatic system pressure).

In the round ride 100 of FIG. 2, maintenance personnel 292 are able to enter the interior space of the central hub structure 110 via a lower access hatch 240 provided in the outer wall 118. A worker 294 may then climb a fixed access ladder 134 mounted to outer wall 118 to climb through a hole or gap in the outer or sphere platform 130. The worker 294 climbs up to elevated portions of the central hub structure 110 through two horizontally oriented support arms 120, and the worker 294 may use the upper surface 222 of the body of the arms 120 adjacent the ladder 134 and outer or sphere platform 130 to walk about and perform maintenance on the outer wall 118 (as or if necessary).

To provide access to the inner wall 116 and hub 114, the round ride 100 is modified to include the deployable maintenance platform assembly 150. Particularly, the assembly 150 includes a number of extension plates that are mounted onto both sides of the arm 120 at or near the inner end 122 with their upper surfaces flush with the upper surface 222 of the arm 120.

As shown, the assembly 150 includes an extension plate 256 that has a planar body (e.g., is formed from plate steel or the like) with an upper surface 257. The plate 256 is rigidly attached to the body of the arm 120 at or near the inner end 122 such that the plate 256 is adjacent or proximate to the inner wall 116 defining or enclosing the hub 114. In other words, when the arm 120 is in the horizontal position as shown in FIG. 2, the plate 256 extends outward from the upper surfaces 222 of the arm 120 and also from the inner wall 116. In this way, the assembly 150 acts to at least partially fill the hole or gap between the adjacent pairs of the arms 120 near the hub 114 as shown in FIG. 1.

In this horizontal position, the upper surface 257 of the extension plate or member 256 is substantially horizontal such that it is typically coplanar (plus or minus 1 to 2 inches) with the upper surface 222 of the body of the arm 120 (e.g., the surface 257 is planar and is parallel to or, more preferably, coplanar with horizontal plane 270). As a result, the maintenance personnel/worker 296 may use the platform formed by the upper surfaces 257 and 222 to perform maintenance on elevated portions of the ride 100 (e.g., on or near the upper portions of wall 116 or hub 114) without needing a safety harness or additional equipment such as a portable ladder.

Figure 3:
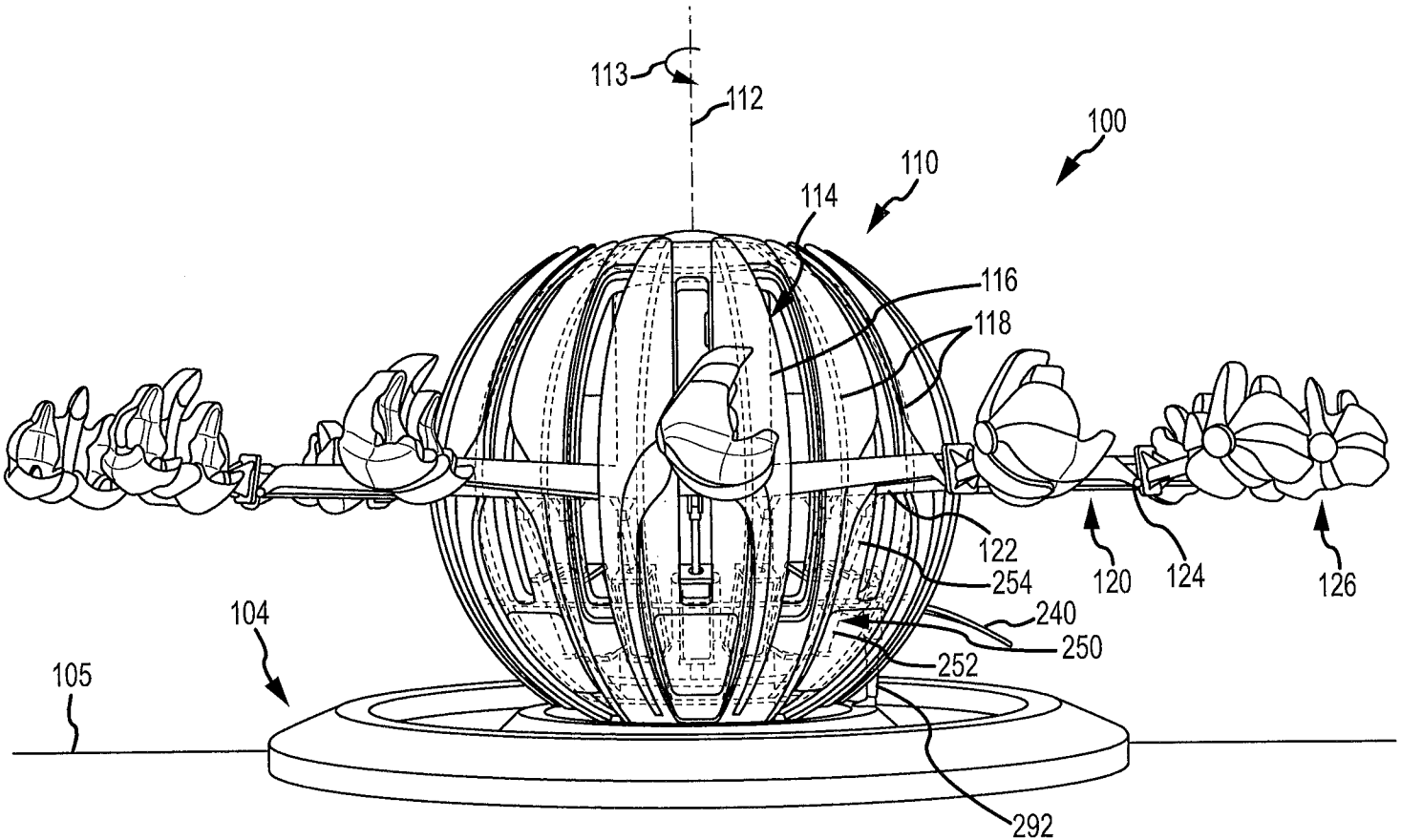
FIG. 3 illustrates another side view of the round ride 100 with portions of the outer side wall 118 removed to show interior components of the hub structure 110.

FIG. 3 illustrates another side view of the round ride 100 with portions of the outer side wall 118 removed (showing only the support frame members of the wall 118) to show interior components of the hub structure 110. As shown, the vehicle support arms 120 are all placed in the maintenance position, i.e., with each body of the arm 120 in a substantially horizontal position or with the upper surfaces and/or longitudinal axes in a horizontal plane. This configuration of round ride 100 may be achieved by operation of a plurality of the actuator assemblies 250 to use pneumatic pistons 252 to move or extend rods 254 to pivot arms 120 into the horizontal position. Then, a blocking valve may be operated to lock the arms 120 in the horizontal position with the pneumatic circuit or system, and, as shown in FIG. 2, a mechanical piston locking device may be installed to provide a mechanical backup to the pneumatic system used to operate the actuators 250.

Figure 4:
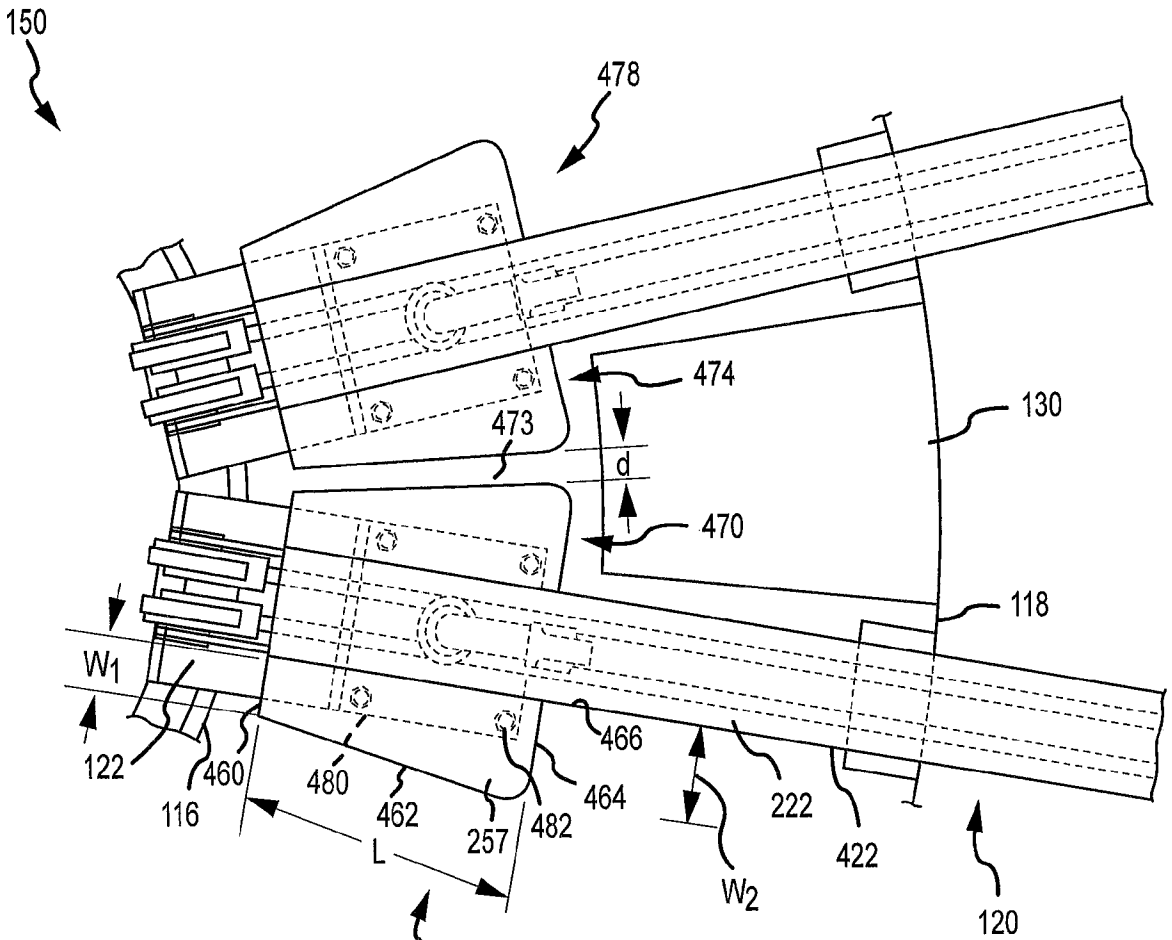
FIG. 4 shows an enlarged top view of a pair of adjacent vehicle support arms in the horizontal position providing more details of an embodiment of the deployable maintenance platform assembly of the present description.

FIG. 4 shows an enlarged top view of a pair of adjacent vehicle support arms 120 in the horizontal position. FIG. 4 is useful for providing more details of an embodiment of the deployable maintenance platform assembly 150 of the present description. In the horizontal position, the arms 20 are adjacent the sphere or outer platform 130 extending inward toward hub wall 116, e.g., the upper arm surface 222 may be flush or coplanar with upper surface of platform 130 to provide an outer walking surface within wall 118.

More importantly, the assembly 150 is deployed to provide a walking surface or platform adjacent or near the hub wall 116 so as to close or fill the gap that previously would have existed between platform 130 and wall 116. To this end, the platform assembly 150 includes a first or right plate 256 and a second or left plate 470 (e.g., a mirror image of the plate 256 with similar mounting to arm 120). The assembly 150 further includes pairs of extension plates 474, 478 on adjacent arm 120 such that there is a small gap or space 473, defined by a separation distance, d, chosen to be up to about 3 to 6 inches to avoid contact or binding between adjacent plates 470, 474 as the neighboring arms 470 are raised above horizontal (e.g., during normal ride operations the arms 120 will typically rise well above horizontal and binding of plates 470, 474 is prevented by providing space/gap 473).

The particular shape and size of each plate 256, 470, 474, 478 may be varied to practice the invention, with these parameters generally being chosen to fill the gap between the arms 120 while providing clearances (gap 473 and a gap between plates and platform 130) to prevent contact with other ride components when the arms 120 are pivoted through a predefined operating range (e.g., −45 degrees to +45 degrees or the like). However, it may be useful to look at one particular plate 256 to discuss one useful configuration and one mounting arrangement to the arm 120.

As shown in FIGS. 2 and 4, the extension plate 256 may have a planar body that extends along a length, L, of the inner end 222 of the arm 120 from a first edge/side 460 to a second edge/side 464. Again, the length, L, of the plate body may vary to substantially fill the gap/hole (e.g., the length, L, may be 80 to 95 percent of the distance between the wall 116 and inner edge of sphere/outer platform 130 or the like) and will vary with the size of the space and size of platform 130, but, in some embodiments, the length is 24 to 48 inches such as 30 to 36 inches or the like. The plate body typically is relatively thin and planar such as a steel plate (e.g., stainless steel deck plate or the like) that is 0.125 to 0.375 inches thick or the like, with the body material, thickness, and configuration (solid or mesh) selected to support workers and maintenance equipment.

The body of the plate 256 is shaped (as defined by ends 460, 464 and also outer side 462 and inner side 466) such that the upper surface 257 has a first width, $W_1$, at the first end 460 that is smaller than a second width, $W_2$, at the second end 464. For example, the first width, $W_1$, may be 6 to 12 inches while the second width, $W_2$, may be 12 to 24 inches. The widths, $W_1$ and $W_2$, will vary to suit the diameter of the hub 114 as defined by wall 116 so as to provide a walking surface or platform that, when combined with the upper surface 222 of the arm 120 to which the plates 256, 470 are attached, is nearly continuous about the periphery of the inner wall 116 or cylindrical hub 114.

As discussed above and shown in FIG. 2, the upper surface 257 is planar and flush and, typically, coplanar with the upper surface 222 of the body of the arm 120 upon which it is mounted. In this way, a worker may readily walk, stand, and otherwise work and move on the platform created by the combined upper surfaces of the left and right plates 256, 470 and sandwiched surface 222 of the inner end 122 of arm 120.

The extension plate 256 is affixed to the side 422 of the body of the arm 120 at or near the inner end 122 so as to extend out as shown in FIGS. 2 and 4 (extend out orthogonally or at least transverse to a vertical plane extending through the longitudinal axis of arm 120). Such attachment may be performed in a variety of ways to practice the round ride 100. For example, as shown, L-brackets or an L-beam 480 may be affixed (welded or bolted or the like) to the sidewall 422 of the body of the arm 120 at or near inner end 122. Then the body of the extension plate 256 may be secured to the L-beam 480 such as with fasteners (e.g., bolts, screws) or by other techniques (such as welding or the like). The extension plate 256 is typically attached such that the inner edge or side 466 abuts or nearly abuts the sidewall 422 or top surface 222 of the body of the arm 120.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A round ride system, comprising:

a central hub assembly with a hub and a hub drive adapted for selectively rotating the hub about a central axis, the hub assembly further including a plurality of vehicle support arms pivotally mounted at a first end to the hub and extending outward to a second end; and a maintenance platform assembly comprising, for each of the vehicle support arms, at least one extension plate proximate to the first end and extending outward from a side of the vehicle support arm, wherein the at least one extension plate includes a planar upper surface and wherein the planar upper surface is coplanar with an upper surface of the vehicle support arm.

2. The system of claim 1, wherein the maintenance platform assembly comprises a pair of the extension plates extending outward from opposite sides of the first end of the vehicle support arm.

3. The system of claim 2, wherein each of the extension plates has a first edge proximate to the hub with a first width and a second edge distal to the hub with a second width greater than the first width.

4. The system of claim 2, wherein the extension plates are configured to be spaced apart from ones of the extension plates on adjacent ones of the vehicle support arms throughout a full range of motion of the vehicle support arms.

5. The system of claim 1, wherein the central hub assembly further includes an actuator for each of the vehicle support arms, wherein the actuators are operable to pivot the vehicle support arms into horizontal positions for maintenance, and wherein the maintenance platform assembly includes mechanical locking devices applied to the actuators to retain the vehicle support arms in the horizontal positions.

6. A round ride system, comprising:

a central hub assembly with a hub and a hub drive adapted for selectively rotating the hub about a central axis, the hub assembly further including a plurality of vehicle support arms pivotally mounted at a first end to the hub and extending outward to a second end; and a maintenance platform assembly comprising, for each of the vehicle support arms, at least one extension plate proximate to the first end and extending outward from a side of the vehicle support arm, wherein the maintenance platform assembly comprises a pair of the extension plates extending outward from opposite sides of the first end of the vehicle support arm, wherein each of the extension plates includes a planar upper surface and wherein the upper surfaces are substantially coplanar with the horizontal plane when the vehicle support arm is positioned in a substantially horizontal position.

7. The system of claim 6, wherein the central hub assembly further includes an actuator for each of the vehicle support arms, wherein the actuators are operable to pivot the vehicle support arms into horizontal positions for maintenance, and wherein the maintenance platform assembly includes mechanical locking devices applied to the actuators to retain the vehicle support arms in the horizontal positions.

8. A round ride, comprising:

a hub assembly including a hub enclosed within an inner wall;

a plurality of vehicle support arms pivotally supported at an inner end by the hub at or proximate to the inner wall;

actuators selectively operable to pivot the vehicle support arms; and a platform member mounted onto the inner end of each of the vehicle support arms, wherein the platform member extending outward from opposite sides of the corresponding one of the vehicle support arm transverse to the longitudinal axis of the vehicle support arm, wherein the platform member comprises a left extension plate and a right extension plate, wherein the left and right extension plates each include an upper planar surface, and wherein the left and right extension plates are affixed to the sides of the vehicle support arm such that the upper planar surfaces are substantially coplanar with an upper surface of the vehicle support arm.

9. The round ride of claim 8, wherein the platform members are spaced apart a separation distance of less than about 6 inches from adjacent ones of the platform members when the actuators are operated to pivot each of the vehicle support arms into a horizontal position.

10. A round ride, comprising:

a hub assembly including a hub enclosed within an inner wall;

a plurality of vehicle support arms pivotally supported at an inner end by the hub at or proximate to the inner wall;

actuators selectively operable to pivot the vehicle support arms; and a platform member mounted onto the inner end of each of the vehicle support arms, wherein the platform member extending outward from opposite sides of the corresponding one of the vehicle support arm transverse to the longitudinal axis of the vehicle support arm, wherein the platform member comprises a left extension plate and a right extension plate, wherein the left and right extension plates each include an upper planar surface, and wherein the upper planar surfaces and the upper surface of the vehicle support arm are substantially coplanar with a horizontal plane when the actuators are operated to pivot each of the vehicle support arms into a horizontal position.

11. The round ride of claim 10, further comprising mechanical locking devices applied to the actuators to retain the vehicle support arms in the horizontal positions.

12. The round ride of claim 11, further comprising, for each of the actuators, a blocking valve in a pneumatic circuit operable to lock the vehicle support arms in the horizontal positions.

13. The round ride of claim 10, wherein the platform members are spaced apart a separation distance of less than about 6 inches from adjacent ones of the platform members when the actuators are operated to pivot each of the vehicle support arms into a horizontal position.

14. A deployable maintenance platform assembly for use in a round ride with a rotatable hub supporting a plurality of pivotally-mounted vehicle support arms, comprising:

a right extension member with a planar upper surface extending outward from a right side of each of the vehicle support arms at an end proximate to the rotatable hub; and a left extension member with a planar upper surface extending outward from a left side of each of the vehicle support arms at the end proximate to the rotatable hub, wherein the right and left extension members each include a body with an upper surface, the upper surfaces being coplanar.

15. The round ride of claim 14, wherein the right and left extension members are affixed to the right and left sides whereby the upper surfaces are substantially horizontal when the vehicle support arms are pivoted to be in a horizontal position.

16. The round ride of claim 14, wherein the uppers surfaces abut and coplanar with an upper surface of one of the vehicle support arms.

17. The round ride of claim 14, wherein the upper surface has a first width at an end proximate to the rotatable hub and a second width at an end distal to the rotatable hub, the second width being greater than the first width.

18. The round ride of claim 14, wherein the right and left extension members have widths along their length that is less than about half the distance between adjacent pairs of the vehicle support arms, whereby a gap between adjacent ones of the left and right extension member with the vertical support arms in a horizontal position is less than about 6 inches.

19. A round ride system, comprising:

a central hub assembly with a hub and a hub drive adapted for selectively rotating the hub about a central axis, the hub assembly further including a plurality of vehicle support arms pivotally mounted at a first end to the hub and extending outward to a second end; and a maintenance platform assembly comprising, for each of the vehicle support arms, at least one extension plate proximate to the first end and extending outward from a side of the vehicle support arm, wherein the maintenance platform assembly comprises a pair of the extension plates extending outward from opposite sides of the first end of the vehicle support arm, and wherein each of the extension plates has a first edge proximate to the hub with a first width and a second edge distal to the hub with a second width greater than the first width.

20. The system of claim 19, wherein the central hub assembly further includes an actuator for each of the vehicle support arms, wherein the actuators are operable to pivot the vehicle support arms into horizontal positions for maintenance, and wherein the maintenance platform assembly includes mechanical locking devices applied to the actuators to retain the vehicle support arms in the horizontal positions.

21. A round ride system, comprising:

a central hub assembly with a hub and a hub drive adapted for selectively rotating the hub about a central axis, the hub assembly further including a plurality of vehicle support arms pivotally mounted at a first end to the hub and extending outward to a second end; and a maintenance platform assembly comprising, for each of the vehicle support arms, at least one extension plate proximate to the first end and extending outward from a side of the vehicle support arm, wherein the maintenance platform assembly comprises a pair of the extension plates extending outward from opposite sides of the first end of the vehicle support arm, and wherein the extension plates are configured to be spaced apart from ones of the extension plates on adjacent ones of the vehicle support arms throughout a full range of motion of the vehicle support arms.

22. The system of claim 21, wherein the central hub assembly further includes an actuator for each of the vehicle support arms, wherein the actuators are operable to pivot the vehicle support arms into horizontal positions for maintenance, and wherein the maintenance platform assembly includes mechanical locking devices applied to the actuators to retain the vehicle support arms in the horizontal positions.

23. A round ride system, comprising:

a central hub assembly with a hub and a hub drive adapted for selectively rotating the hub about a central axis, the hub assembly further including a plurality of vehicle support arms pivotally mounted at a first end to the hub and extending outward to a second end; and a maintenance platform assembly comprising, for each of the vehicle support arms, at least one extension plate proximate to the first end and extending outward from a side of the vehicle support arm, wherein the central hub assembly further includes an actuator for each of the vehicle support arms, wherein the actuators are operable to pivot the vehicle support arms into horizontal positions for maintenance, and wherein the maintenance platform assembly includes mechanical locking devices applied to the actuators to retain the vehicle support arms in the horizontal positions.

24. A round ride, comprising:

a hub assembly including a hub enclosed within an inner wall;

a plurality of vehicle support arms pivotally supported at an inner end by the hub at or proximate to the inner wall;

actuators selectively operable to pivot the vehicle support arms; and a platform member mounted onto the inner end of each of the vehicle support arms, wherein the platform member extending outward from opposite sides of the corresponding one of the vehicle support arm transverse to the longitudinal axis of the vehicle support arm, and wherein the platform members are spaced apart a separation distance of less than about 6 inches from adjacent ones of the platform members when the actuators are operated to pivot each of the vehicle support arms into a horizontal position.

25. The round ride of claim 24, wherein the platform member comprises a left extension plate and a right extension plate and wherein the left and right extension plates each include an upper planar surface.

26. A deployable maintenance platform assembly for use in a round ride with a rotatable hub supporting a plurality of pivotally-mounted vehicle support arms, comprising:

a right extension member with a planar upper surface extending outward from a right side of each of the vehicle support arms at an end proximate to the rotatable hub; and a left extension member with a planar upper surface extending outward from a left side of each of the vehicle support arms at the end proximate to the rotatable hub, wherein the right and left extension members have widths along their length that is less than about half the distance between adjacent pairs of the vehicle support arms, whereby a gap between adjacent ones of the left and right extension member with the vertical support arms in a horizontal position is less than about 6 inches.

* * * * *